United States Patent [19]

Isobe et al.

[11] Patent Number: 4,520,784

[45] Date of Patent: Jun. 4, 1985

[54] METHOD OF AND APPARATUS FOR CONTROLLING FUEL INJECTION

[75] Inventors: Toshiaki Isobe, Nagoya; Teruo Fukuda, Kobe, both of Japan

[73] Assignee: Toyota Jidosha Kabushiki Kaisha, Toyota, Japan

[21] Appl. No.: 637,024

[22] Filed: Aug. 2, 1984

[30] Foreign Application Priority Data

Aug. 5, 1983 [JP] Japan ..... 58-143272
Aug. 5, 1983 [JP] Japan ..... 58-143273

[51] Int. Cl.[3] ..... F02B 3/00

[52] U.S. Cl. ..... 123/492; 123/488; 123/490

[58] Field of Search ..... 123/490, 492, 488, 494

[56] References Cited

U.S. PATENT DOCUMENTS 4,002,152 1/1977 Hoshi ..... 123/71
4,197,767 4/1980 Leung ..... 123/436
4,266,522 5/1981 Williams ..... 123/492

FOREIGN PATENT DOCUMENTS 47-42407 3/1970 Japan ..... 123/492
55-146934 1/1980 Japan ..... 123/492
55-74286 7/1982 Japan ..... 123/492
2056723 9/1973 United Kingdom ..... 123/440

*Primary Examiner*—Ronald B. Cox
*Attorney, Agent, or Firm*—Cushman, Darby & Cushman

[57] ABSTRACT

There is disclosed an internal combustion engine in which synchronous fuel injection is conducted at every predetermined crank angle and an asynchronous fuel injection is conducted regardless of the crank angle. The engine is provided with an electronical control circuit which computes a quantity of fuel to be injected in each synchronous fuel injection on the basis of a load applied to the engine and an engine speed. A variance of intake pressure in said engine is computed. The computed variance is compared with a reference level which is determined to be greater as the intake pressure becomes higher. In the case of detection of the variance of the intake pressure being greater than said reference level, said quantity of fuel to be injected is increased.

20 Claims, 19 Drawing Figures

SYNCHRONOUS ROUTINE
COMPUTATION OF TP ON THE BASIS OF PM AND NE
S1
S2
LL SWITCH OFF ?
YES
NO
COMPUTATION OF ΔPM, ΔΔPM
S3
DETERMINATION OF REFERENCE LEVELS RP1, RP2 FROM PM-RP1 MAP, PM-RP2 MAP
S4
S5
ΔΔPM ≧ RP2
YES
NO

METHOD OF AND APPARATUS FOR CONTROLLING FUEL INJECTION

BACKGROUND OF THE INVENTION

The present invention relates to a method of and an apparatus for controlling injection of a fuel into an internal combustion engine. More particularly, the invention is concerned with a fuel injection controlling method and apparatus in which the rate of synchronous injection is increased and/or asynchronous injection is conducted in response to a change in the intake pressure of the engine.

Modern internal combustion engines are equipped with an electronic fuel injection controller which is adapted to effect a synchronous fuel injection in synchronism with stroking of pistons, i.e. at every predetermined crank angle, at a rate which is computed on the basis of the load on the engine and the engine speed. In this type of engine, the electronic fuel injection controller has a function of effecting an acceleration incremental correction in which the rate of synchronous fuel injection is increased when the engine acceleration demand is higher than a predetermined level and also a function to effect an asychronous fuel incremental injection in which the fuel injection rate is increased regardless of the crank angle when the engine acceleration demand is higher than the predetermined level.

In some engines of the type described, the pressure of intake air in the intake pipe of the engine is used as the index of the engine acceleration demand so that the acceleration incremental correction and the asynchronous incremental injection are effected when the amount of change in the intake pressure is higher than a predetermined reference level. In these engines, the reference level is maintained constant regardless of the level of the load applied to the engine. In addition, this reference level is selected to be rather small, in order that the acceleration incremental correction and the asynchronous incremental injection may easily be carried out even when the load applied to the engine is comparatively low.

This known fuel injection control encounters the following problem. Namely, in the full-load operation of the engine, a large pulsation of intake pressure takes place in the intake pipe. It is, therefore, often experienced that the reference level of the intake pressure change is exceeded by the amplitude of pulsation of the intake pressure so that the acceleration incremental correction or the asynchronous incremental injection are put into effect undesirably even though there is no substantial demand for engine acceleration. In such a case, the air-fuel mixture is rendered excessively rich adversely affecting the performance of the engine and the exhaust emissions, as well as the fuel consumption.

SUMMARY OF THE INVENTION

Accordingly, an object of the invention is to provide a method of and apparatus for controlling fuel injection, wherein the undesirable acceleration incremental correction and/or asynchronous incremental injection are eliminated thereby ensuring the optimum air-fuel ratio of the mixture during operation of the engine.

One form of the invention is directed to a fuel injection controlling method and apparatus having a function of effecting an acceleration incremental correction and/or a function of effecting an asynchronous incremental injection when the amount of change of the intake pressure exceeds a predetermined reference level, wherein the higher the intake pressure becomes, the larger the reference level is set to be.

Another form of the invention is directed to a fuel injection controlling method and apparatus having a function of effecting an acceleration incremental correction and/or a function of effecting an asynchronous incremental injection when the amount of change of the intake pressure exceeds a predetermined reference level, wherein the higher the intake pressure becomes, the larger the reference level is set to be and the lower the engine coolant temperature becomes, the smaller the reference level is set.

According to one form of the invention, the undesirable synchronous acceleration incremental correction and/or asynchronous incremental injection in the heavy load range of the engine operation is avoided to enable the engine to operate constantly at the optimum air-fuel ratio, thereby attaining good conditions of exhaust emission and air-fuel ratio.

According to another form of the invention, the lower the engine cooling water temperature becomes, the smaller the reference level is set. In some engines, the idle speed is increased when the cooling water temperature of the engine is low, i.e. when the engine is still in the cold state. In these engines, the intake pressure is increased in the cold state due to the increase of the intake air quantity for the high idle speed. If the first form of the invention stated above is applied to such engines, the reference level is increased due to the increase of the intake pressure in the cold state so that the acceleration incremental correction and/or the asynchronous incremental correction can hardly be effected. In another form of the invention, this problem can be obviated because the reference level is decreased when the cooling water temperature is low, i.e. when the engine is still in cold state.

DESCRIPTION OF THE PREFERRED EMBODIMENTS

Figure 1:
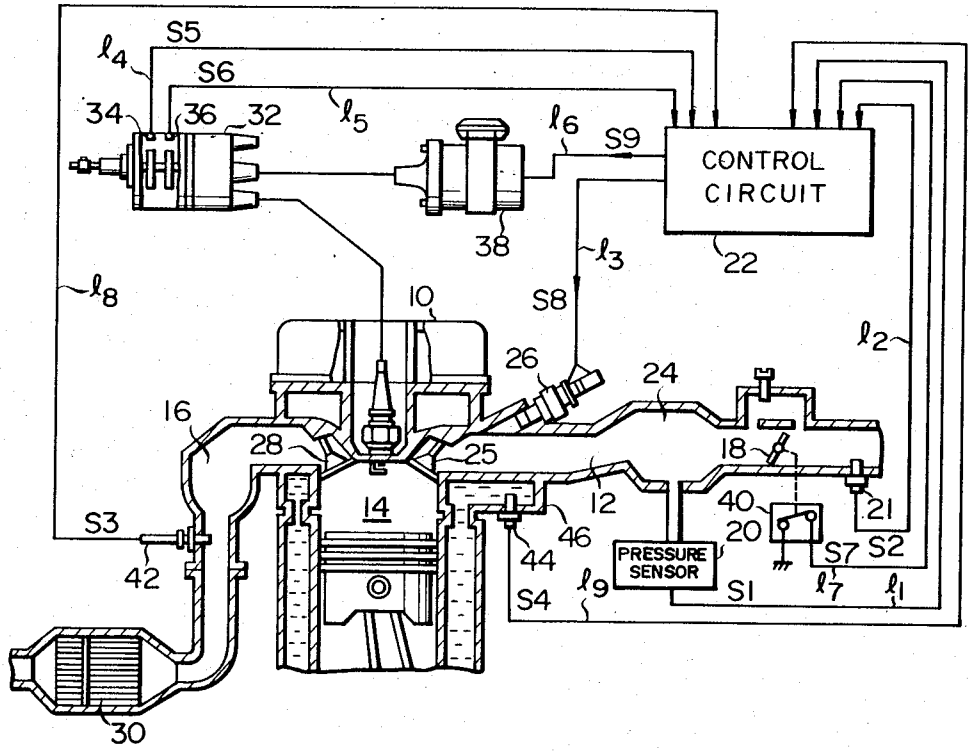
FIG. 1 is a schematic illustration of an internal combustion engine having a fuel injection controlling apparatus embodying the present invention.

FIG. 1 shows an example of an internal combustion engine equipped with an electronic fuel injection control to which the present invention is applied. In this Figure, the engine generally designated by a numeral 10 has an intake passage 12, combustion chambers 14 and an exhaust passage 16. An intake absolute pressure sensor 20 provided in the portion of the intake passage downstream from a throttle valve 18 is connected to a control circuit 22 through a signal line $l_1$ and produces a voltage corresponding to the absolute value of the intake pressure. An intake air temperature sensor 21 provided in the portion of the intake passage 12 upstream from the throttle valve 18 is connected to the control circuit 22 through a signal line $l_2$ and produces a voltage corresponding to the temperature of the intake air. In the operation of the engine, the air is induced through an air cleaner (not shown) and is introduced into the combustion chamber 14 of each cylinder through the throttle valve 18, a surge tank 24 and an intake valve 25. The flow rate of the intake air is controlled by the throttle valve 18 which is operatively connected to an accelerator pedal (not shown).

Each cylinder is equipped with a fuel injector 26 which operates in response to driving pulses supplied from the control circuit 22 through a signal line $l_3$. When the fuel injector 26 opens, the pressurized fuel coming from a fuel supply system (not shown) is injected to the portion of the intake passage 12 in the vicinity of the intake valve 25, i.e., into the portion near the intake port. The gas produced as a result of the combustion in the combustion chamber 14 is emitted to the atmosphere through the exhaust valve 28, exhaust passage 16 and a ternary catalyst converter 30.

A distributor 32 has crank angle sensors 34 and 36 which are connected to a control circuit 22 through signal lines $l_4$ and $l_5$. These sensors 34 and 36 are adapted to produce pulse signals for each 30° and 360° rotation of the crankshaft, respectively. These pulse signals are delivered to the control circuit 22 through the signal lines $l_4$ and $l_5$.

The distributor 32 is connected to an igniter 38 which in turn is connected to the control circuit 22 through a signal line $l_6$.

A reference numeral 40 designates an idle switch (LL switch) operatively connected to the throttle valve 18 and adapted to be closed when the throttle valve is fully closed. This switch is connected to the control circuit 22 through a signal line $l_7$.

An $O_2$ sensor 42 disposed in the exhaust passage 16 is adapted to produce a signal in response to the oxygen content of the exhaust gas. More specifically, the output from the $O_2$ sensor is stepwise changed around the stoichiometric level of the air-fuel ratio. The output of the $O_2$ sensor 42 is connected through the signal line $l_8$ to a control circuit 22. The ternary catalyst converter 30 is disposed on the downstream side of the $O_2$ sensor 42 to remove three main noxious components, i.e., HC, CO and NOx from the exhaust gas to ensure a clean exhaust emission.

A reference numeral 44 designates a water temperature sensor adapted to detect the temperature of the engine cooling water and to produce a voltage corresponding to the detected water temperature. The water temperature sensor 44 is mounted on the cylinder block 46 and is connected to the control circuit 22 through a signal line $l_9$.

Figure 2:
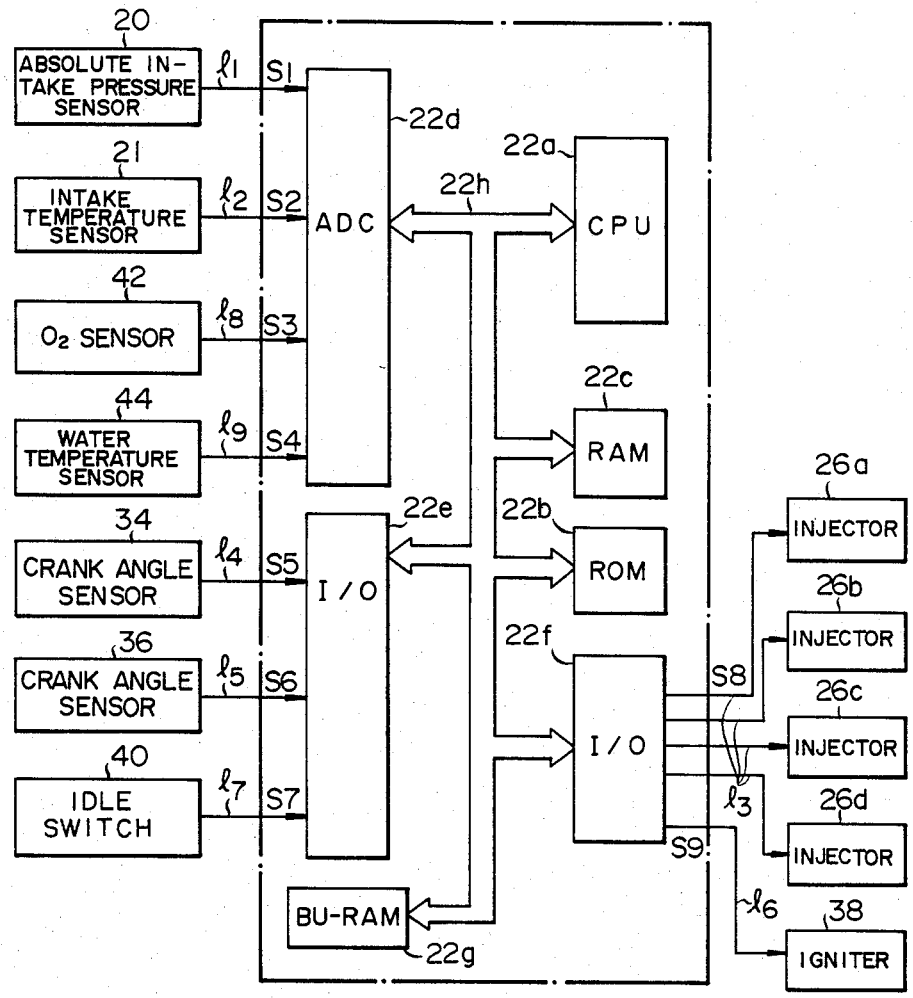
FIG. 2 is a block diagram showing the detail of the control circuit of FIG. 1.

FIG. 2 shows the detail of the control circuit 22. The control circuit 22 has a central processing unit CPU **22*a* adapted to control various equipment, a read only memory (ROM) 22*b*, a random access memory (RAM) 22*c* having areas in which the values under processing and flags are written, an A/D converter (ADC) 22*d* having an analog multiplexing function and adapted to convert the analog input signal into a digital signal, an input/output interface (I/O) 22*e* through which various digital signals are inputted, an input/output interface (I/O) 22*f* through which various digital signals are outputted, a back-up memory (BU-RAM) 22*g* adapted to be supplied with power from an auxiliary power supply when the engine is not operated so as to hold the content of memory, and a BUS line 22*h*** to which these components are connected.

The ROM **22*b*** stores various programs such as a main processing routine program, interruption processing routine program for computing fuel injection pulse width (fuel injection rate), interruption processing routine programs for computing various coefficients such as air-fuel ratio feedback correction coefficients, asyncronous routine program and other programs, as well as various data which are necessary for the execution of these programs.

The pressure sensor 20, intake air temperature sensor 21, $O_2$ sensor 42 and the water temperature sensor 44 are connected to the A/D converter **22*d*, so that the voltage signals S1,S2,S3 and S4 from these sensors are successively changed into binary signals in accordance with the instructions given by the CPU 22*a***.

The control circuit 22 receives through the I/O **22*e* signals such as the pulse signal S5 produced by the crank angle sensor 34 at every 30° rotation of crankshaft, pulse signal S6 produced by the crank angle sensor 36 at every 360° rotation of the crankshaft and the idle signal S7 from the idle switch 40. A binary signal representing the engine speed is produced in accordance with the pulse signal S5. The pulse signals S5 and S6 in cooperation form signals such as an interruption demand signal for computation of the fuel injection pulse width, a fuel injection start signal and a cylinder identification signal. The idle signal S7 represents whether the throttle valve 18** is fully closed or not.

The I/O **22*f* passes a fuel injection signal and an ignition signal S9, which are formed through various computations, to the fuel injectors 26*a* to 26*d* and the igniter 38**, respectively.

Figures 3, 3A, 3B:
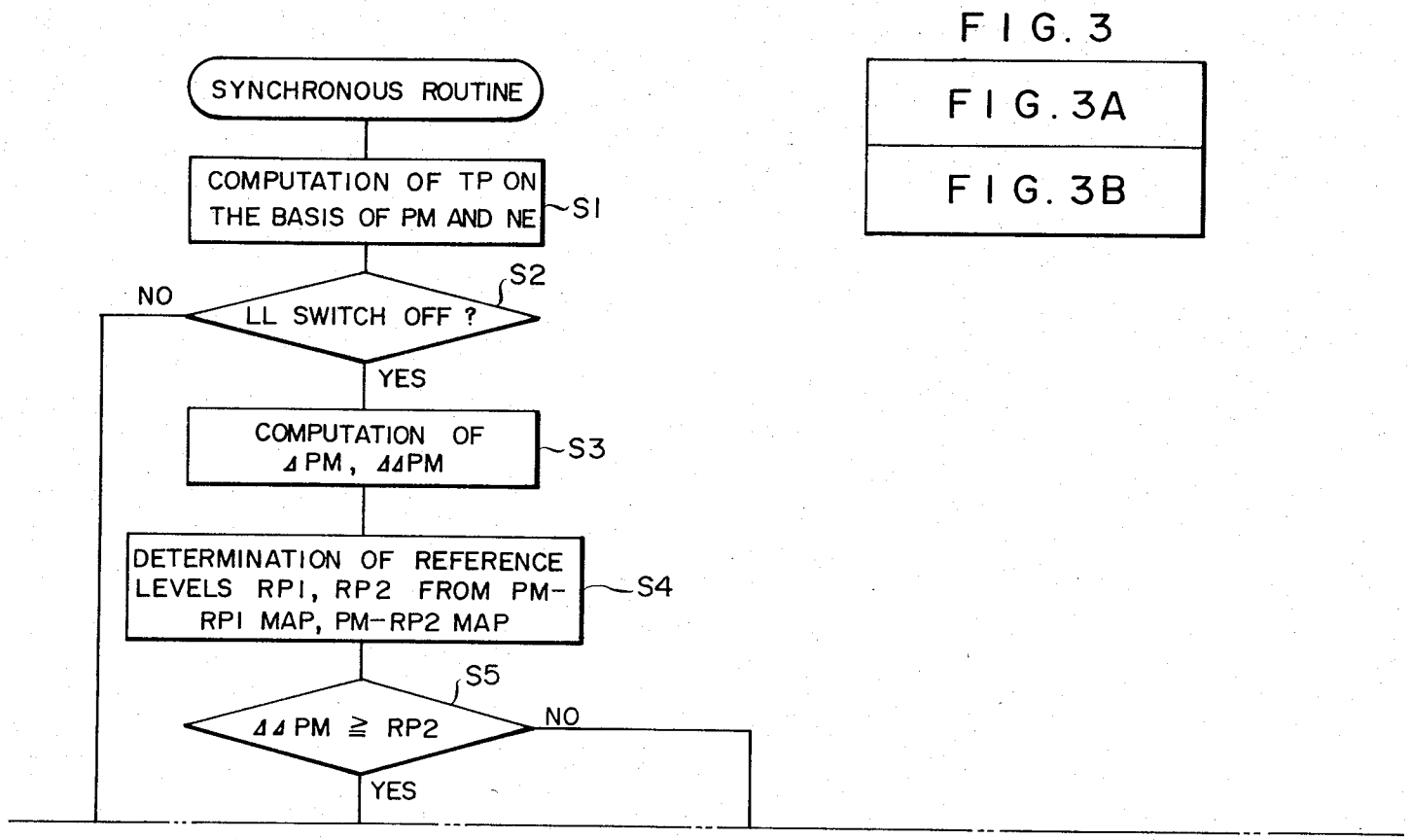
FIGS. 3*a* and 3*b* are flow charts of a synchronous injection routine in accordance with an embodiment of the invention.
Figure 3B:
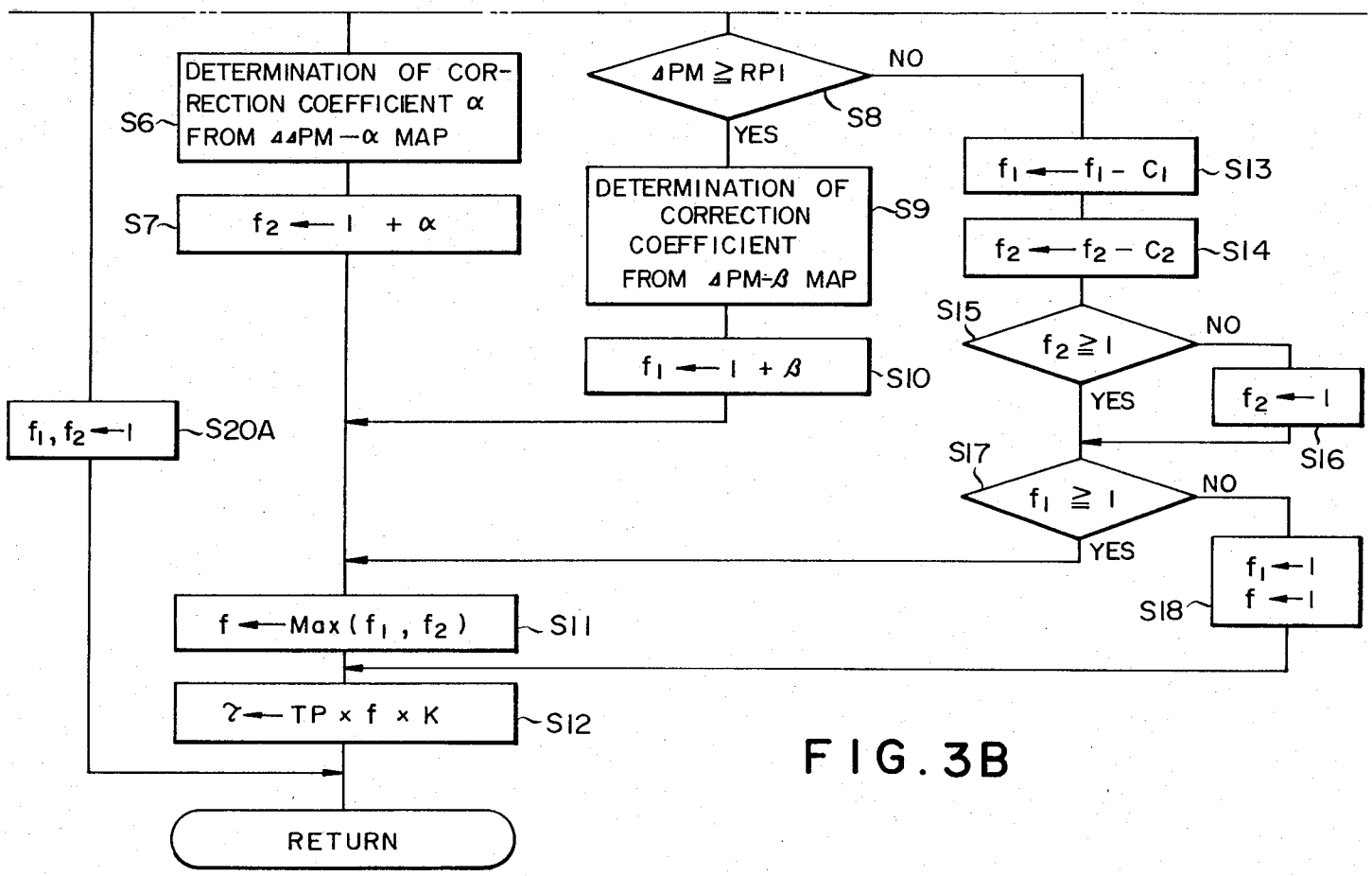
Figure 10:
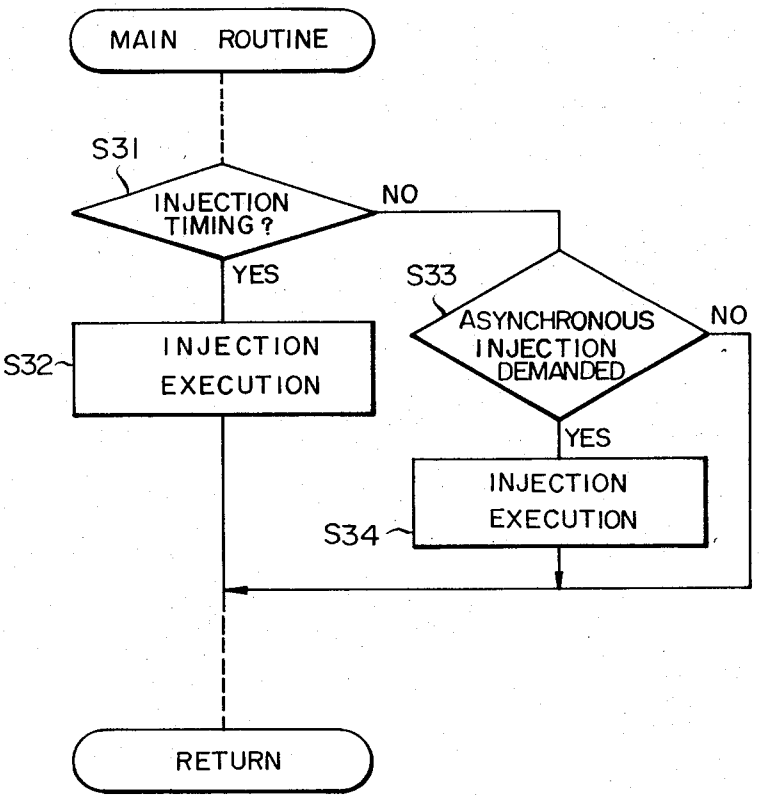
FIG. 10 is a flow chart showing an example of the main routine.
Figure 9:
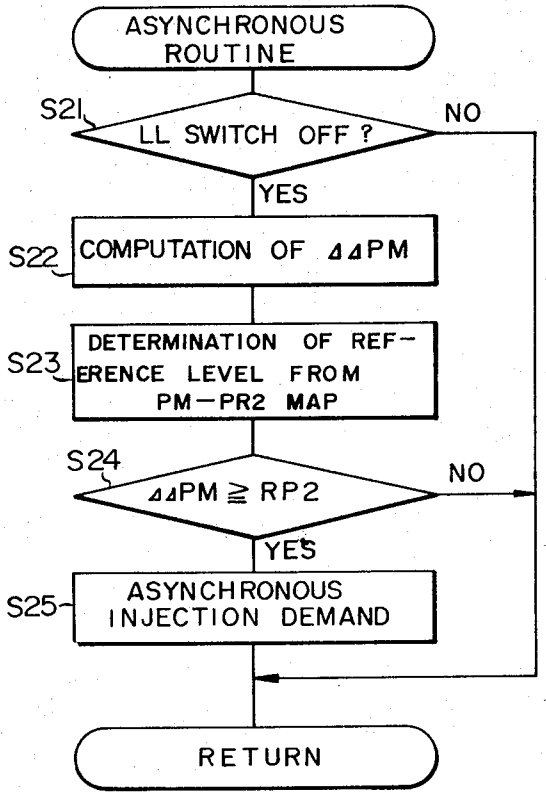
FIG. 9 is a flow chart showing an example of asynchronous demand routine in accordance with the invention.

In the internal combustion engine equipped with the fuel injection controlling apparatus of this embodiment, the fuel injection is executed in accordance with the routine programs as shown in FIGS. 3, 9 and 10.

Figure 4:
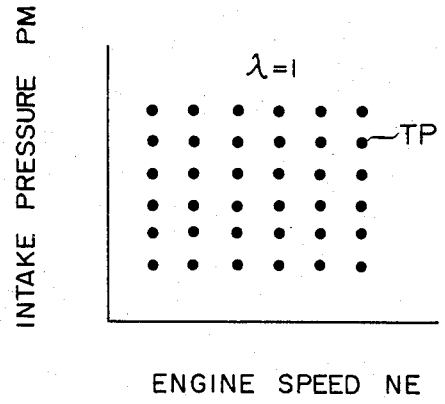
FIG. 4 is an illustration of a map showing basic fuel injection time duration.

The synchronous injection routine shown in FIG. 3 is a crank angle interruption routine which is started by the above-mentioned interruption demand signal. In a step S1, the basic fuel injection time duration TP is computed from the map shown in FIG. 4, on the basis of the intake pressure PM and the engine speed NE. In a next step S2, a judgement is made as to whether the idle switch 40 has been opened or not, i.e., whether the throttle valve 18 has been substantially fully closed, using the idle signal S7. If the judgement proves that the throttle valve 18 is not substantially fully closed, ΔPM and ΔΔPM which are the variances of the intake pressure PM are computed in a step S3. More specifically, the variance ΔPM is determined as the difference between the successive intake pressures $PM_i$ and $PM_{i+1}$ which are taken up at a predetermined period, while the variance ΔΔPM is determined as the difference between successive $\Delta PM_i$ and $\Delta PM_{i+1}$. Thus, the variance ΔPM is the first order differentiation value of the intake pressure PM with respect to time, while the variance ΔΔPM is the second order differentiation value of the intake pressure PM with respect to time.

Figure 5:
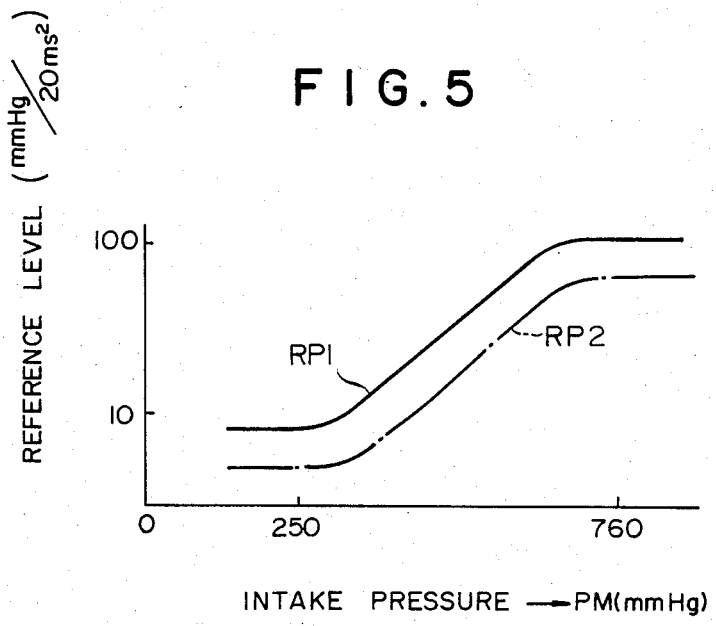
FIG. 5 is a graph showing reference levels RP1 and RP2.

The relationship between the intake pressure PM and a reference level RP1 as shown by the solid line in FIG. 5, as well as the relationship between the intake pressure PM and another reference level RP2 as shown by the broken line in FIG. 5, is written in the ROM 22*b*. These reference levels RP1 and RP2 are determined such as to become larger as the intake pressure PM is increased.

Then, a step S4 is executed so that the reference level RP1 for first order differentiation value ΔPM and the reference level RP2 for second order differentiation value ΔΔPM are determined in accordance with the graph shown in FIG. 5, respectively.

Figure 6:
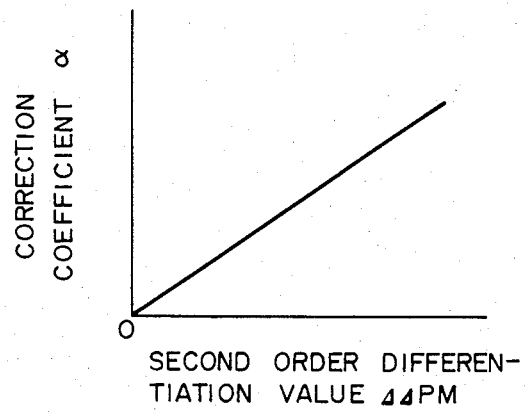
FIG. 6 is a graph showing the relationship between $\Delta\Delta PM$ and a correction coefficient $\alpha$.
Figure 7:
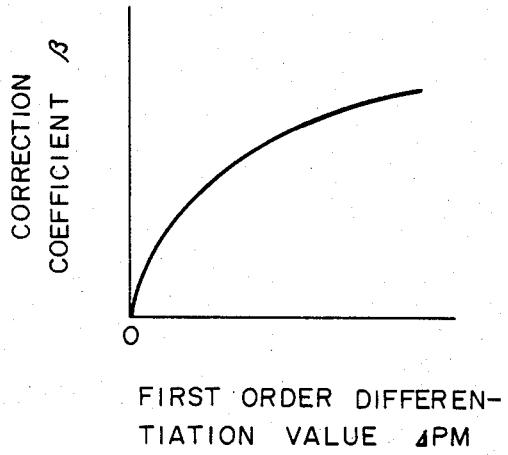
FIG. 7 is a graph showing $\Delta PM$ and a correction coefficient $\beta$.
Figures 8A, 8B, 8C, 8D:
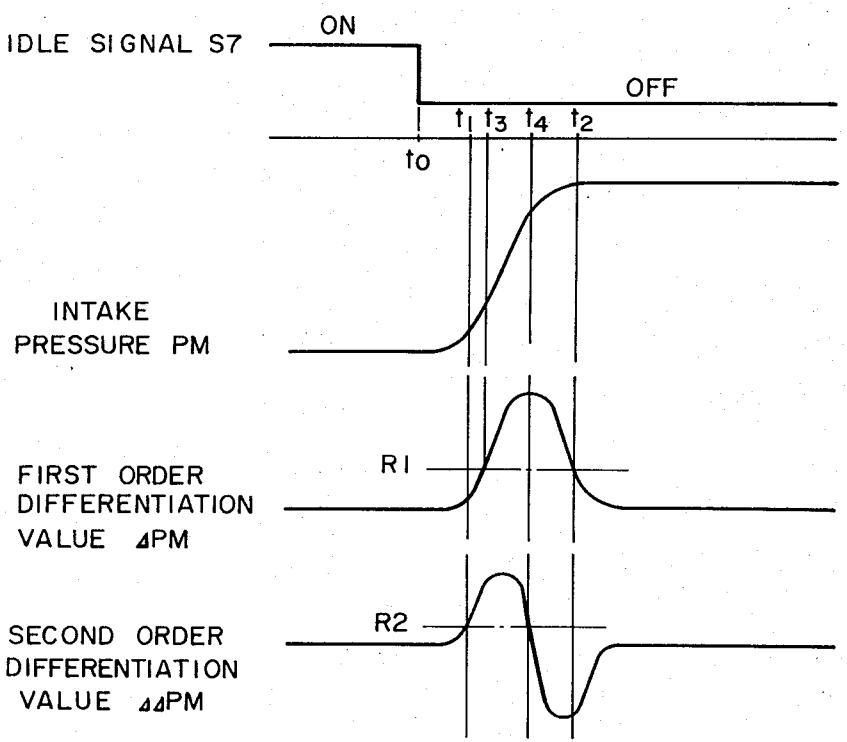
FIGS. 8A to 8D are time charts showing an idle signal; intake pressure, first order differential value $\Delta PM$ and second order differential value $\Delta\Delta PM$.

The ROM 22*b* stores also a graph showing the relationship between the second order differentiation value ΔΔPM and the correction coefficient $\alpha$ as shown in FIG. 6, as well as the graph representing the relationship between the first order differentiation value ΔPM and the correction coefficient $\beta$ as shown in FIG. 7.

In a next step S5, a judgement is made as to whether the second order differentiation value ΔΔPM is higher than the reference level RP2 or not. If the answer is affirmative, the process proceeds to the next step S6 in which the correction coefficient $\alpha$ is determined in accordance with the graph shown in FIG. 6. In a next step S7, a value $(1+\alpha)$ is stored as the correction coefficient $f_2$ in a predetermined area.

In contrast, if the answer in the step S5 is negative, a judgement is made in a step S8 as to whether the first order differentiation value ΔPM is greater than the reference level RP1 or not. If the answer is affirmative, the correction coefficient $\beta$ is determined in a step S9 on the basis of the first order differentiation value ΔPM, in accordance with the graph shown in FIG. 7. Then, the process proceeds to a step S10 in which a value $(1+\beta)$ is stored as the correction coefficient $f_1$ in a predetermined area of the RAM 22*c*.

In a next step S11, the greater one of the two correction coefficients $f_1$ and $f_2$ is selected, and is used as the acceleration incremental correction coefficient f. In a step S12, the final fuel injection time duration $\tau$ is determined by multiplying the basic fuel injection time duration TP by the thus determined acceleration incremental correction coefficient f and a correction coefficient k which is computed by other routines (not shown) and includes correction coefficients for cooling water temperature and intake air temperature, air-fuel feedback correction coefficient and so forth.

On the other hand, if the answer in the step S8 is negative, the process proceeds to a step S13 in which a predetermined number c1 is subtracted from the correction coefficient $f_1$ and the result is determined as the new correction coefficient $f_1$. In a step S14, a predetermined value $c_2$ ($c_2 > c_1$) is subtracted from the correction coefficient $f_2$ and the result is determined as the new correction coefficient $f_2$. In a next step S15, a judgement is made as to whether the correction coefficient $f_2$ is "1" or greater. If the correction coefficient $f_2$ is smaller than "1", the correction coefficient $f_2$ is set as being "1" in a step S16. In the next step S17, a judgement is made as to whether the correction coefficient $f_1$ is "1" or greater. If the answer is affirmative, the process proceeds to the step S11 and in turn to the step S12 so that the process explained before is executed to determine the injection time duration.

On the other hand, if the throttle valve 18 is fully closed to give a negative answer in the judgement conducted in the step S2, the correction coefficients $f_1$ and $f_2$ are set to be "1" in a step S20A and the process proceeds to the step S14 for determining the injection time duration $\tau$. In this case, the acceleration incremental correction is not executed.

In sum, according to the synchronous injection routine as shown in FIG. 3, when the throttle valve 18 is not in the fully closed position, the first and second order differentiation values ΔPM and ΔΔPM of the intake pressure PM with respect to time are computed at first. The reference levels PR1 and PR2, which are predetermined to take greater value as the intake pressure PM becomes higher, are read out from the map. If the second order differentiation value PM is higher than the reference level RP2, the correction coefficient $\alpha$ is determined in accordance with the second order differentiation value ΔΔPM. Subsequently, the correction coefficient $f_2$ is set as $(1+\alpha)$. Meanwhile, the correction coefficient $f_1$ for the first order differentiation value ΔPM is stored in a predetermined area. Then, the greater of these correction coefficients $f_1$ and $f_2$ is selected and used as the acceleration incremental correction coefficient f by means of which the fuel injection time duration $\tau$ is determined. When the second order differentiation value ΔΔPM becomes smaller than the reference level RP2 and the first order differentiation value ΔPM grows above the reference level PR1, the correction coefficient $\beta$ is determined in acordance with the first order differentiation value ΔPM, and the correction coefficient $f_1$ for the first order differentiation value is rewritten to be $(1+\beta)$. Then, the fuel injection time duration $\tau$ is computed by using of the greater one of the correction coefficients $f_1$ and $f_2$. If both of the first and second order differentiation values ΔPM and ΔΔPM are below respective reference levels, predetermined values are subtracted from the coeficients $f_1$ and $f_2$, respectively. In the described embodiment, the correction coefficient $f_2$ first comes down below "1" so that this correction coefficient $f_2$ is forcibly set to be "1". Thereafter, the value of the correction coefficient $f_1$ is used as the acceleration incremental correction factor f. Then, when the correction coefficient $f_1$ has come down below "1", this correction coefficient "f" also is forcibly set at "1". In this state, both of the correction coefficient $f_1$ and the acceleration incremental correction coefficient f take the value "1", so that the acceleration incrementary correction is not conducted in this case.

The values of the first order differentiation value ΔPM and the second order differentiation value ΔΔPM are changed in response to a change in the intake pressure PM in a manner shown in FIGS. 8A to 8D.

An explanation will be given hereinunder as to the asynchronous incremental injection routine, with specific reference to FIG. 9.

This asynchronous incremental injection routine is an interrupting routine which is started at a constant period. Namely, in a step S21, the idle signal S7 is examined to judge whether the throttle valve 18 is in substantially fully closed position. If the answer is affirmative, the second order differentiation value ΔΔPM of the intake pressure PM with respect to time is computed in a step P22. Then, in a step S23, the reference level RP2 is determined by the same procedure as that in the step S4 of the routine shown in FIG. 3.

Subsequently, in a step S24, a judgement is made as to whether the second order differentiation value ΔΔPM is the reference level RP2 or greater. If the answer is affirmative, the value "1" is set in an asynchronous demand flag representing a demand for asynchronous injection in a step S25, thus completing this routine.

If the negative answer is obtained in the steps S21 and S24, the routine is completed without making asynchronous injection demand.

Referring now to FIG. 10 showing the main routine program, a judgement is made in a step S31 as to whether the present moment coincides with the synchronous injection timing, using the 30° crank signal S5 and the 360° crank signal S6. If so, in a step S32, the fuel injection time duration $\tau$ which has been determined by the synchronous routine is set in a down counter (not shown) and the injection signal S8 is supplied to the injection valve 26 to execute the injection. The injection is ceased when the content of the down counter is reduced to zero.

If the result of judgement in the step S31 is negative, i.e., if the present moment does not coincide with the injection timing, a judgement is made in a step S33 as to whether there is a demand for asynchronous injection, in accordance with the content of the asynchronous demand flag. If the content of the flag is "1", asynchronous injection is executed in a step S34 in the same manner as the synchronous injection. The quantity of fuel injected by this asynchronous injection corresponds to a predetermined time duration $\tau_{ASY}$. It is not essential that the asynchronous injection is made immediately after the generation of the asyncronous injection demand. Namely, the quantity of fuel to be injected asnchronously may be added to the quantity of fuel which is to be injected in the next synchronous injection period.

The invention does not exclude such a modification that only the first order differentiation value PM is used so that the acceleration incremental correction is conducted when the reference level is exceeded by the first order differentiation value ΔPM. However, it is more preferred to use both the first order differentiation valve ΔPM and the second order differentiation value ΔΔPM as in the case of the described embodiment, because a quicker acceleration incremental correction can be achieved since the second order differentiation value ΔΔPM comes to exceed its reference level befofre the first order differentiation value grows to exceed its reference level, as will be seen from FIGS. 8A to 8D.

Although in the described embodiment the basic fuel injection time duration is determined in accordance with the intake pressure and the engine speed, this is not exclusive and the basic fuel injection time duration may be determined on the basis of the flow rate of intake air and the engine speed.

It is also possible to modify the described embodiment such that the increase of the reference level in response to an increase of the intake pressure is conducted only in connection with the judgement for the synchronous acceleration incremental correction or only in connection with the judgement for the asynchronous incremntal injection.

Another preferred embodiment of the present invention will be explained here under referring to FIGS. 11–14.

Figures 11, 11A, 11B:
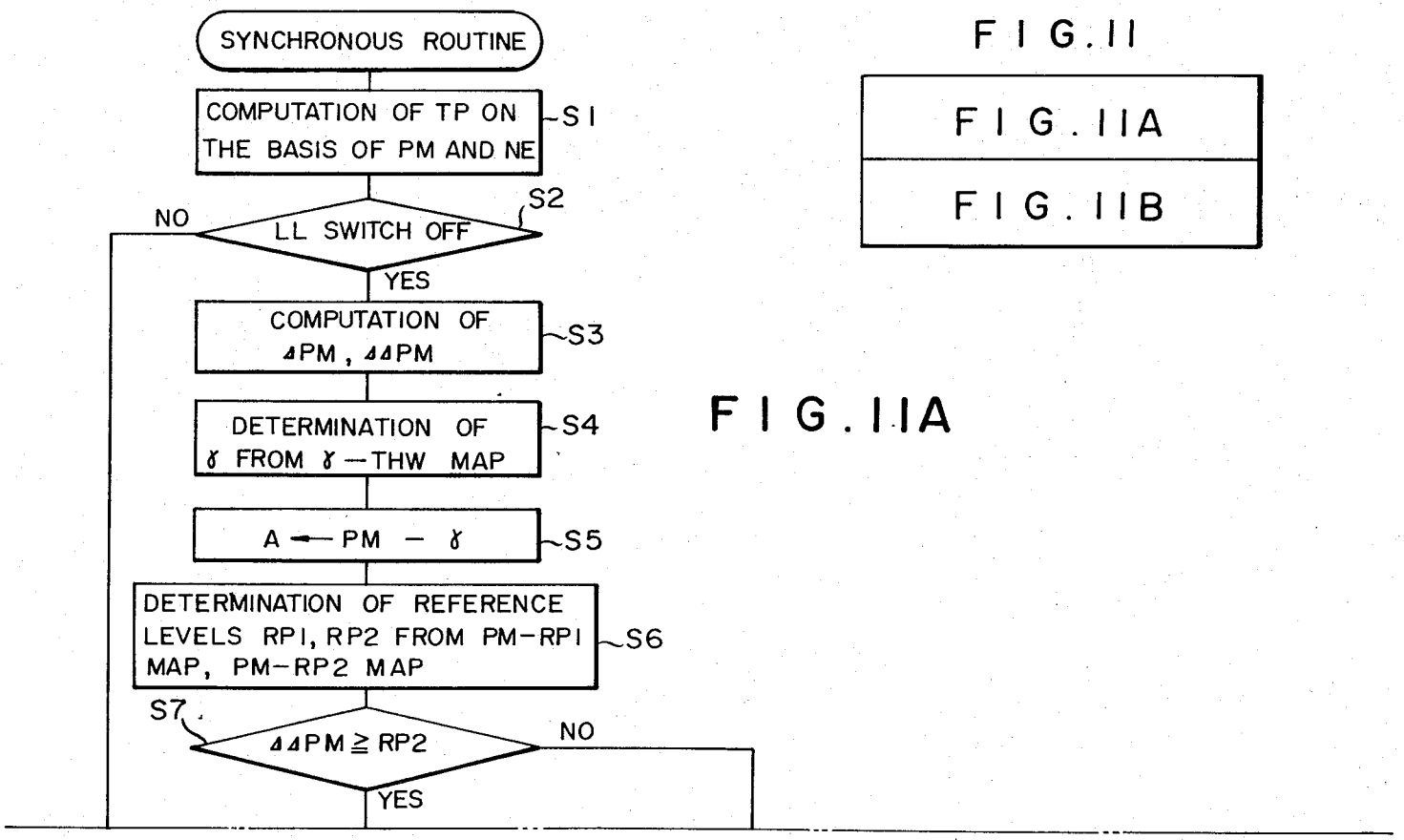
FIGS. 11*a* and 11*b* are flow charts showing an example of the synchronous injection routine in accordance with another form of the invention.
Figure 11B:
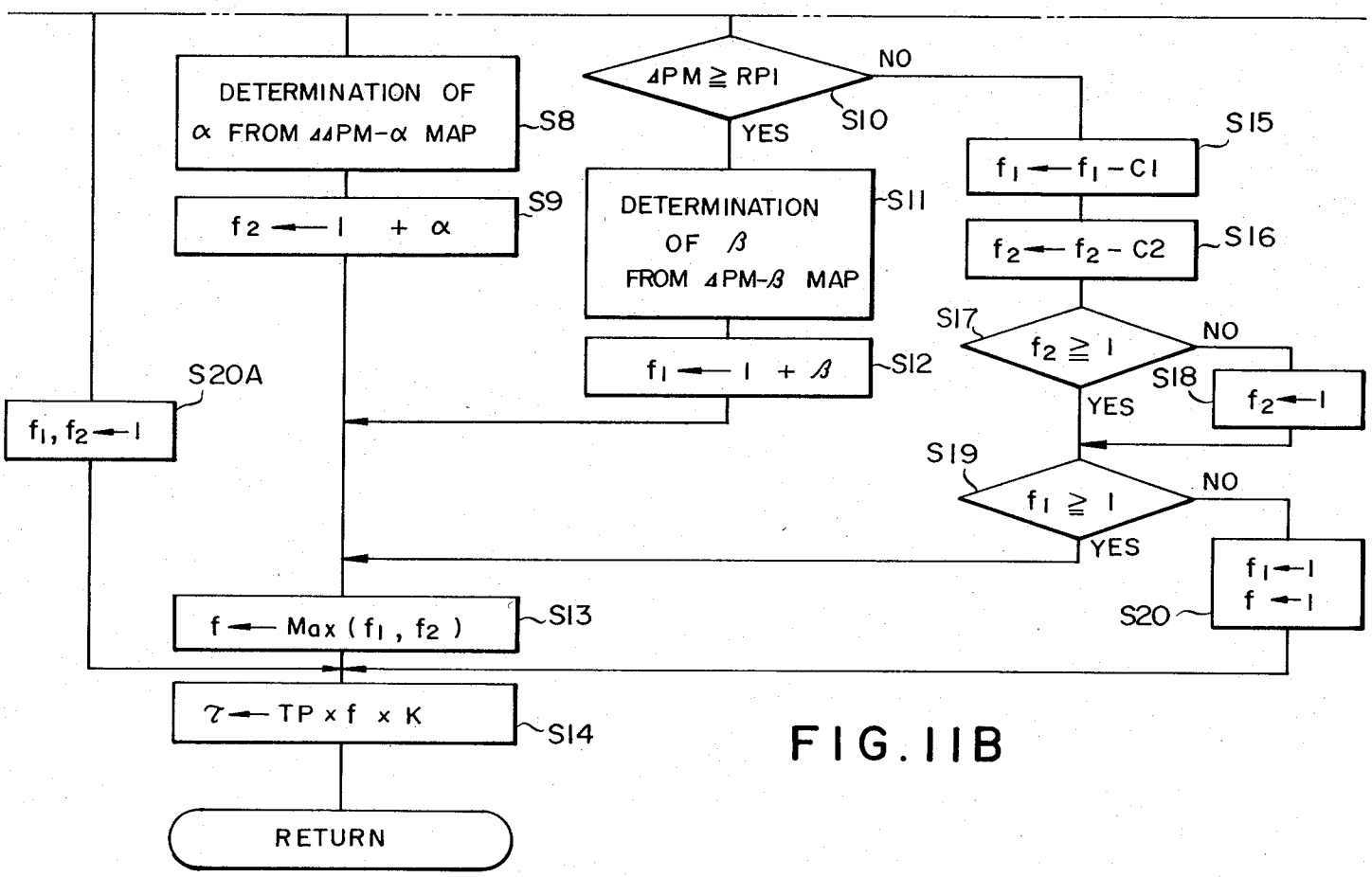
Figure 12:
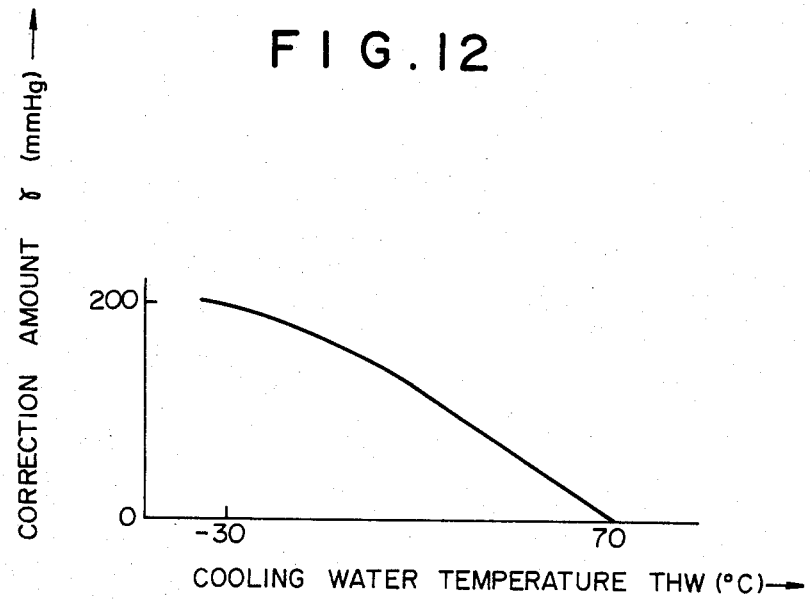
FIG. 12 is a graph showing the relationship between the cooling water temperature THW and the correction amount $\gamma$.

The synchronous injection routine shown in FIG. 11 is a crank angle interruption routine which is started by the above-mentioned interruption demand signal. In a step S1, the basic fuel injection time duration TP is computed from the map shown in FIG. 4, on the basis of the intake pressure PM and the engine speed NE. In a next step S2, a judgement is made as to whether the idle switch 40 has been opened or not, i.e., whether the throttle valve 18 has been closed substantially fully, using the idle signal S7. If the judgement proves that the throttle valve 18 is not closed substantially fully, ΔPM and ΔΔPM which are the variances of the intake pressure PM with respect to time are computed in a step S3. More specifically, the variance ΔPM is determined as the difference between the successive intake pressures $PM_i$ and $PM_{i+1}$ which are taken up at a predetermined period, while the variance ΔΔPM is determined as the difference between successive $\Delta PM_i$ and $\Delta PM_{i+1}$. Thus, the variance ΔPM is the first order differentiation value of the intake pressure PM with respect to time, while the variance ΔΔPM is the second order differentiation value of the intake pressure PM with respect to time.

In the ROM **22*b*, a correction amount $\gamma$ as a function of the engine cooling water temperature THW is written in the form of $\gamma$-THW map. The correction amount $\gamma$ is predetermined to be small as the cooling water temperature becomes higher. In a step S4, the correction amount $\gamma$ is determined on the basis of the cooling water temperature THW from the $\gamma$-THW map mentioned above. Then, the process proceeds to a step S5** in which the correction amount $\gamma$ is subtracted from the present intake pressure PM and the result is stored in a predetermined area such as A register.

Figure 13:
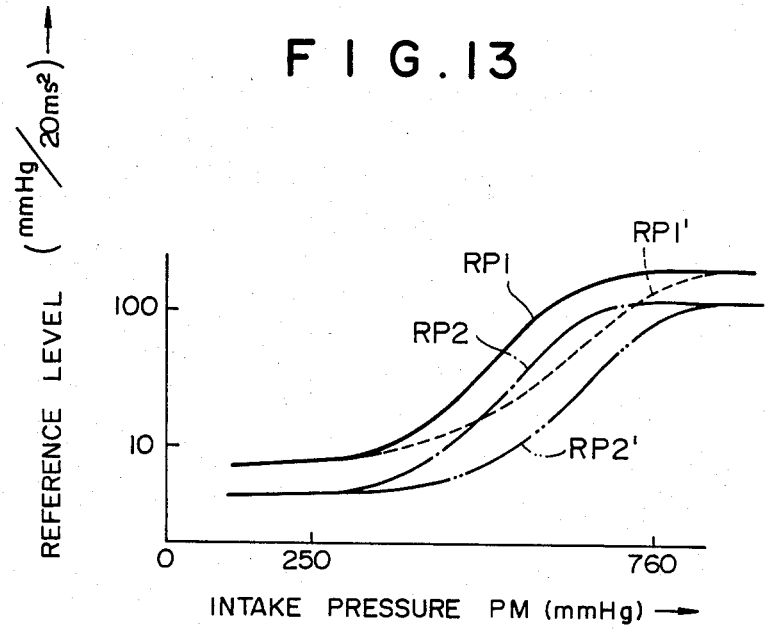
FIG. 13 is a graph showing the reference levels RP1 and RP2.

A reference level RP1 as a function of the intake pressure PM, shown by the solid line in FIG. 13, and another reference level RP2 as a function of the intake pressure PM, shown by the dot-dash-line in FIG. 13 are written in the ROM 22, in the form of PR1-PM map and PR2-PM map, respectively. These reference levels RP1 and RP2 are determined such as to become larger as the intake pressure PM is increased.

Then, a step S6 is executed so that the reference level RP1 for first order differentiation value ΔPM and the reference level RP2 for second order differentation value ΔΔPM are determined from the PR1-PM map and the PR2-PM map stored in the ROM 22.

Therefore, the reference levels PR1 and PR2 thus determined take values which become greater as the intake pressure PM increases and smaller as the cooling water temperature THW becomes lower. For instance, when the cooling water temperature THW is 0° C., the reference levels RP1 and RP2 are varied as shown by the dotted line PR1′ and the two-dots-dash-line PR2′ in FIG. 13.

The ROM 22 stores also the correction coefficient $\alpha$ as a function of the second order differentiation value ΔΔPM as shown in FIG. 6, as well as the correction coefficient $\beta$ as a function of the first order differentiation value ΔPM as shown in FIG. 7, in the forms of $\alpha$-ΔΔPM map and $\beta$-ΔPM map, respectively.

In a next step S7, a judgement is made as to whether the second order differentiation value ΔΔPM is higher than the reference level RP2 or not. If the answer is affirmative, the process proceeds to the next step S8 in which the correction coefficient $\alpha$ is determined on the basis of the second order differentiation value ΔΔPM from the ΔΔPM-$\alpha$ map. In the next step S9, the correction coefficient $f_2$ is written as a value $(1+\alpha)$ to store it in a predetermined area.

In contrast, if the answer in the step S7 is negative, a judgement is made in a step S10 as to whether the first order differentiation value ΔPM is greater than the reference level RP1 or not. If the answer is affirmative, the correction coefficient $\beta$ is determined in a step S11 on the basis of the first order differentiation value ΔPM, from the ΔPM-$\beta$ map mentioned above.

Then, the process proceeds to a step S12 in which a value $(1+\beta)$ is stored as the correction coefficient $f_1$ in a predetermined area.

In a next step S13, the greater of the two correction coefficients $f_1$ and $f_2$ is selected, and is used as the acceleration incremental correction coefficient f. In a step S14, the final fuel injection time duration $\tau$ is determined by multiplying the basic fuel injection time duration TP by the thus determined acceleration incremental correction coefficient f and a correction coefficient k which is computed by other routines (not shown) and includes correction coefficients for cooling water temperature and intake air temperature, air-fuel feedback correction coefficient and so forth.

On the other hand, if the answer in the step S10 is negative, the process proceeds to a step S15 in which a predetermined number c1 is subtracted from the correction coefficient $f_1$ and the result is determined as the new correction coefficient $f_1$. In a step S16, a predetermined value $c_2$ ($c_2 > c_1$) is subtracted from the correction coefficient $f_2$ and the result is determined as the new correction coefficient $f_2$. In a next step S17, a judgement is made as to whether the correction coefficient $f_2$ is "1" or greater. If the correction coefficient $f_2$ is smaller than "1", the correction coefficient $f_2$ is set at "1" in a step S18. In the next step S19, a judgement is made as to whether the correction coefficient $f_1$ is "1" or greater. If the answer is affirmative, the process proceeds to the step S13 so that the process explained before is executed to determine the injection time duration $\tau$.

If a negative answer is obtained in the step S19, the acceleration incremental correction coefficient f and the correction coefficient $f_1$ are set at "1" in the step S20 and the process proceeds to the step S14 for the determination of the injection time duration $\tau$.

On the other hand, if the throttle valve 18 is fully closed to give a negative answer in the judgement conducted in the step S2, the correction coefficients $f_1$ and $f_2$ are set to be "1" in a step S20A and the process proceeds to the step S14 for determining the injection time duration $\tau$. In this case, the acceleration incremental correction is not executed.

In sum, according to the synchronous injection routine as shown in FIG. 11, when the throttle valve 18 is not in the fully closed position, the first and second order differentiation values ΔPM and ΔΔPM of the intake pressure PM with respect to time are computed. The reference levels PR1 and PR2 which are predetermined to take greater value as the intake pressure PM is higher are read out from the map. If the second order differentiation value PM is equal to or higher than the reference level RP2, the correction coefficient $\alpha$ is determined in accordance with the second order differentiation value ΔΔPM. Subsequently, the correction coefficient $f_2$ is set as $(1+\beta)$. Then, the greater of these correction coefficients $f_1$ and $f_2$ is selected and used as the acceleration incremental correction coefficient f by means of which the fuel injection time duration $\tau$ is determined. When the second order differentiation value ΔΔPM is equal to or smaller than the reference level RP2 and the first order differentiation value ΔPM is equal to or grows above the reference level PR1, the correction coefficient $\beta$ is determined in accordance with the first order differentiation value ΔPM, and the correction coefficient $f_1$ for the first order differentiation value is set as $(1+\beta)$. Then, the fuel injection time duration $\tau$ is computed by the greater one of the correction coefficients $f_1$ and $f_2$. Further, if both of the first and second order differentiation values ΔPM and ΔΔPM are below respective reference levels, predetermined values are subtracted from the coefficients $f_1$ and $f_2$, respectively. In the described embodiment, the correction coefficient $f_2$ first comes down below "1" so that this correction coefficient $f_2$ is forcibly set to be "1". Thereafter, the value of the correction coefficient $f_1$ is used as the acceleration incremental correction factor f. Then, when the correction factor $f_1$ has come down below "1", this correction coefficient "f" also is forcibly set at "1". In this state, both of the correction coefficient $f_1$ and the acceleration incremental correction coefficient f take the value "1", so that the acceleration incrementary correction is not conducted in this case.

The values of the first order differentiation value ΔPM and second order differentiation value ΔΔPM are changed in response to a change in the intake pressure PM in a manner shown in FIGS. 8A to 8D.

Figure 14:
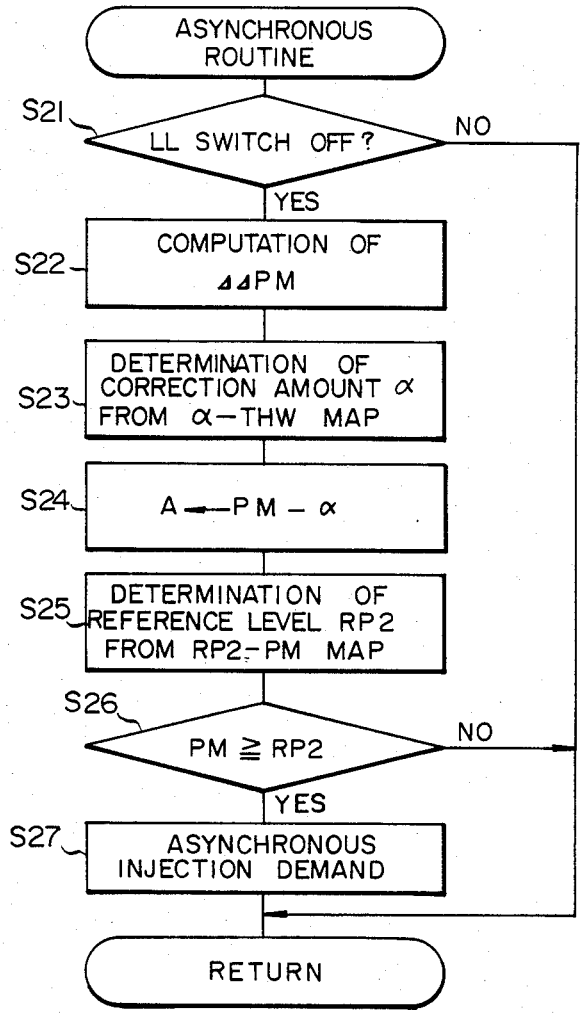
FIG. 14 is a flow chart showing an example of asynchronous injection routine in accordance with another form of the invention.

An explanation will be given hereinunder as to the asynchronous incremental injection routine, with specific reference to FIG. 14.

This asynchronous incremental injection routine is an interrupting routine which is started at a regular interval. Namely, in a step S21, the idle signal S7 is examined to judge whether the throttle valve 18 is in a substantially fully closed position. If the answer is affirmative, the second order differentiation value ΔΔPM of the intake pressure PM with respect to time is computed in a step P22. Then, in steps S23 to S25, the reference level RP2 is determined by the same procedure as that in the steps S4 to S6 of the routine shown in FIG. 11.

Subsequently, in a step S26, a judgement is made as to whether the second order differentiation value ΔΔPM is equal to or greater than the reference level PR2. If the answer is affirmative, the value "1" is set in an asynchronous demand flag representing a demand for asynchronous injection in a step S27, thus completing this routine.

If the negative answer is obtained in the steps S21 and S26, the routine is completed without making asynchronous injection demand.

What is claimed is:

1. In an internal combustion engine in which synchronous fuel injection is conducted at every predetermined crank angle and an asynchronous fuel injection is conducted regardless of a crank angle, a method of controlling a fuel injection comprising the steps of:

computing a variance of intake pressure in said engine;

comparing the computed variance with a reference level which is predetermined to get greater as the intake pressure becomes higher; and increasing, in the case of detection of the variance of the intake pressure being greater than said reference level, a quantity of fuel to be injected.

2. A method according to claim 1 further comprising the steps of; computing, on the basis of a load applied to the engine and an engine speed, a quantity of fuel to be injected in each synchronous fuel injection; wherein the injection fuel quantity is increased at said every predetermined crank angle in response to the variance being greater than said reference level.

3. A method according to claim 1, wherein upon detecting said variance being greater than said reference level, predetermined increment of fuel is injected as said asynchronous fuel injection.

4. A method according to claim 2, wherein the computation of the variance of intake pressure is conducted so as to determine $\Delta PM$ which is defined by difference between successively detected intake pressures PMi and $PM_{i+1}$ and $\Delta\Delta PM$ which is defined by difference between successively determined variances of intake pressure $\Delta PMi$ and $\Delta PM_{i+1}$, said reference level comprises a first reference level determined by said variance $\Delta PM$ and a second reference level determined by said variance $\Delta\Delta PM$, a first and second coefficients for an incremental correcting of said synchronous fuel injection are determined when $\Delta PM$ and $\Delta\Delta PM$ are greater that said first and second reference levels, respectively and said incremental correction is conducted in accordance with the greater one of said first and second coefficients.

5. A method according to claim 3, wherein the computation of the variance of intake pressure is conducted so as to determine $\Delta\Delta PM$ which is defined by difference between successively determined variance of intake pressures $\Delta PMi$ and $\Delta PM_{i+1}$, both of which are defined by difference between successively detected intake pressures PMi and $PM_{i+1}$.

6. A method according to claim 1, wherein said reference level is determined so as to get smaller as an engine cooling water becomes lower and get greater as the intake pressure becomes higher.

7. A method according to claim 2, wherein said reference level is determined so as to get smaller as an engine cooling water becomes lower and get greater as the intake pressure becomes higher.

8. A method according to claim 3, wherein said reference level is determined so as to get smaller as an engine cooling water becomes lower and get greater as the intake pressure becomes higher.

9. A method according to claim 4, wherein said reference level is determined so as to get smaller as an engine cooling water becomes lower and get greater as the intake pressure becomes higher.

10. A method according to claim 5, wherein said reference level is determined so as to get smaller as an engine cooling water becomes lower and get greater as the intake pressure becomes higher.

11. In an internal combustion engine in which synchronous fuel injection is conducted at every predetermined crank angle and an asynchronous fuel injection is conducted regardless of a crank angle, an apparatus for controlling a fuel injection comprising:

means for computing a variance of intake pressure in said engine;

means for comparing the computed variance with a reference level which is predetermined to get greater as the intake pressure becomes higher; and means for increasing, in the case of detection of the variance of the intake pressure being greater than said reference level, a quantity of fuel to be injected.

12. An apparatus according to claim 11 further comprising means for computing, on the basis of a load applied to the engine and an engine speed, a quantity of fuel to be injected in each synchronous fuel injection; wherein an incremental of fuel determined by said increasing means is added to the computed fuel injection quantity at said every predetermined crank angle.

13. An apparatus according to claim 11, wherein upon detecting said variance being greater than said reference level, an incremental of fuel determined by said increasing means is injected regardless of position of the crank angle as the asynchronous fuel injection.

14. An apparatus according to claim 12, wherein said means for computing the variance computes the variance of intake pressure so as to determine $\Delta PM$ which is defined by difference between successively detected intake pressures PMi and $PM_{i+1}$ and $\Delta\Delta PM$ which is defined by difference between successively determined variances of intake pressure $\Delta PMi$ and $\Delta PM_{i+1}$, said reference level comprises a first reference level determined by said variance $\Delta PM$ and a second reference levelo determined by said variance $\Delta\Delta PM$, and wherein said increasing means includes means for determining a first and second coefficients for an incremental correction of said synchronous fuel injection determined when $\Delta PM$ and $\Delta\Delta PM$ are greater that said first and second reference levels, respectively, means for selecting the greater one of said first and second coefficients and means for correcting said fuel injection quantity in accordance with the thus selected coefficient.

15. An apparatus according to claim 13, wherein said means for computing the variance computes the variance of intake pressure is conducted so as to determined $\Delta\Delta PM$ which is defined by difference between successively determined variance of intake pressures $\Delta PMi$ and $\Delta PM_{i+1}$, both of which are defined by difference between successively detected intake pressure PMi and $PM_{i+1}$.

16. An apparatus according to claim 11, wherein said reference level is determined so as to get smaller as an engine cooling water becomes lower and get greater as the intake pressure becomes higher.

17. An apparatus according to claim 12, wherein said reference level is determined so as to get smaller as an engine cooling water becomes lower and get greater as the intake pressure becomes higher.

18. An apparatus according to claim 13, wherein said reference level is determined so as to get smaller as an engine cooling water becomes lower and get greater as the intake pressure becomes higher.

19. An apparatus according to claim 14, wherein said reference level is determined so as to get smaller as an engine cooling water becomes lower and get greater as the intake pressure becomes higher.

20. An apparatus according to claim 15, wherein said reference level is determined so as to get smaller as an engine cooling water becomes lower and get greater as the intake pressure becomes higher.

* * * * *